United States Patent [19]

Johnson

[11] Patent Number: 4,884,817

[45] Date of Patent: Dec. 5, 1989

[54] THREE-DIMENSIONAL GAME AND GAMEBOARD

[76] Inventor: Terrence A. Johnson, 164 Palm Dr., Apt. 8, Naples, Fla. 33969

[21] Appl. No.: 344,536

[22] Filed: Apr. 26, 1989

Related U.S. Application Data

[63] Continuation of Ser. No. 679,552, Dec. 7, 1984, abandoned.

[51] Int. Cl.[4] ..... A63F 3/00

[52] U.S. Cl. ..... 273/241

[58] Field of Search ..... 273/241, 260, 261

[56] References Cited

U.S. PATENT DOCUMENTS

| | | | |
|---|---|---|---|
| D. 172,790 | 8/1954 | Kaye et al. | 273/241 X |
| 1,899,177 | 2/1933 | Bedell | 273/264 |
| 2,313,473 | 3/1943 | Heacock et al. | 273/24 |
| 2,727,745 | 12/1955 | Jenkins | 273/264 |
| 3,399,895 | 9/1968 | Bench | 273/241 |
| 4,333,654 | 6/1982 | Allain | 273/241 |

*Primary Examiner*—William H. Grieb
*Assistant Examiner*—Benjamin Layno
*Attorney, Agent, or Firm*—Merrill N. Johnson

[57] ABSTRACT

A three dimensional game played by two players each having five identical playing pieces. The game is played on three similar boards or grids lying in three vertically spaced parallel planes. Each board contains thirteen spaces, nine of which form a central square with one of the four remaining spaces lying adjacent to the center of each of the four sides of the central square. To begin the game, the first player places one of his five pieces in the four outermost spaces and in the central space of the uppermost gameboard called the Alpha grid while the opposing player places his five pieces in the corresponding spaces of the lowermost gameboard called the Omega grid. The middle board is called the neutral grid. The central space of the Alpha and the Omega grids is that player's base and the object of the game is to capture the opponent's base by landing a piece on it or by first capturing all of the opponent's pieces. An opponent's piece is captured by jumping over an opponent's piece lying an adjoining space and landing in a vacant space on the opposite side of the opponent's piece. Except for jumping, each piece may move only one space at a time horizontally or vertically but diagonal vertical moves are not permitted.

5 Claims, 1 Drawing Sheet

THREE-DIMENSIONAL GAME AND GAMEBOARD

This application is a continuation of application Ser. No. 679,552, filed on Dec. 7, 1984, now abandoned.

BACKGROUND AND SUMMARY OF THE INVENTION

For centuries mankind has engaged in games of skill in which two opponents take turns moving pieces according to predetermined rules over the surface of a gameboard. At least three such games—chess, checkers and the Japanese game of go—continue to enjoy worldwide popularity.

In recent years a number of three-dimensional games, that is games using at least two vertically spaced gameboards, have been suggested as is evident from U.S. Pat. Nos. 2,313,473; 2,801,107; 3,399,895; 3,606,333; 3,747,931; 3,806,124; 4,082,283; 4,184,685; 4,204,685 and 4,333,654. However, so far as I am aware, none of the three-dimensional board games thus far suggested have met with wide use or popularity.

Accordingly, I have invented a novel three-dimensional board game called the Alpha-Omega Encounter which because of its unique features can be played to a final conclusion in most cases in from 10 to 30 minutes. Its rules and playing techniques are quickly and easily grasped by children and adults alike, and yet winning the game is almost entirely a matter of skill rather than luck.

The Alpha-Omega Encounter is played on a unique gameboard comprising three similar boards or grids lying in three vertically spaced planes. Each of the three boards is divided into thirteen similar spaces or squares. Nine of the spaces form a square, three spaces on each side of the square surrounding a central space. The remaining four spaces lie outside the square with one space lying next to the center space of each of the four sides of the square.

Each player is given five similarly colored pieces preferably in the form of spheres. The first player places his five spheres in the four outermost spaces and the central space of the upper board called the Alpha grid, while the second player places his spheres in the similar spaces of the lower board called the Omega grid. The middle board is called the neutral grid.

The object of the game is to place a sphere on the central space of the opponent's grid, called the base, or to capture and remove from the gameboard all of the opponent's spheres. A piece is captured by jumping over that piece from an adjoining space and landing in a vacant space on the opposite side of the captured piece and then moving to an adjoining vacant space. As in the game of checkers, if the opponent's pieces are appropriately positioned, sequential jumps may be taken during the same turn.

Except when jumping over an opponent's piece, a piece may move only to any adjoining empty space. However, a move to an upper or lower grid must be to the space directly above or below—a diagonal vertical move is not permitted.

Play starts by random determination (flip of a coin or roll of a die) of which player goes first. The first player moves one of his pieces one horizontal or vertical space. The second player follows and the game continues until one player lands one of his pieces on the opponent's base or his opponent loses all five of his pieces.

BRIEF DESCRIPTION OF THE DRAWINGS

The features of my invention will be fully understood from the following description and the accompanying drawing in which.

DESCRIPTION OF THE PREFERRED EMBODIMENTS

Figure 1:
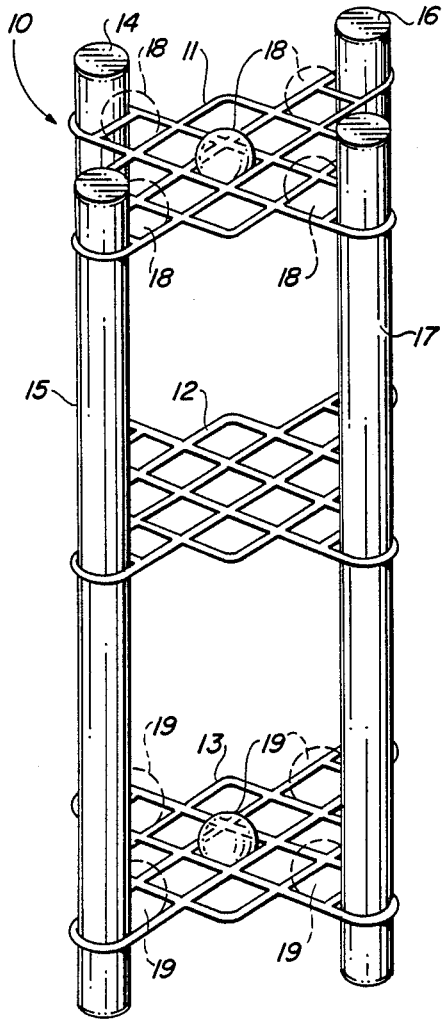
FIG. 1 is a perspective view of one form of my novel gameboard showing the playing pieces at the start of a game.

FIG. 1 of the drawings illustrates one form of my unique three-dimensional gameboard and shows the location of the spherical playing pieces at the beginning of an Alpha-Omega Encounter game.

Gameboard 10 includes three identical wire mesh grids 11, 12 and 13 which are held in vertically spaced relationship by four similar tubular posts 14, 15, 16 and 17.

Figure 3:
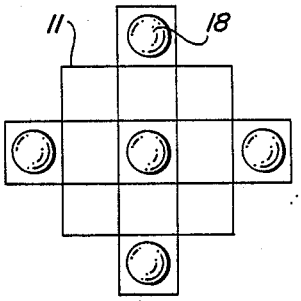
FIG. 3 is a diagramatic plan view of the uppermost board of the gameboard shown in FIG. 1 with the playing pieces in their starting position.

Each of grids 11, 12 and 13 are constructed of galvanized wire mesh or cast from a suitable plastic material such as nylon. Each grid contains a total of thirteen playing spaces or squares. The inner relationship of these playing squares is best shown in FIG. 3 which is a diagramatic illustration of the playing pieces on grid 11 at the start of an Alpha-Omega Encounter game. Nine of the squares are arranged into a central matrix in the form of a larger square with three of the playing squares on each of the four sides of the central matrix surrounding a central square. The four remaining playing squares are located outside the central matrix with one of the remaining squares lying adjacent to the center square of each side of the central matrix.

Upper grid 11 is called the Alpha grid. Lower grid 13 is called the Omega grid. The center grid 12 is called the neutral grid. At the start of a game, the player assigned to the Alpha grid is given five identically colored playing pieces or spheres 18 and he places four of his spheres in the four outermost playing squares of the Alpha grid and his remaining sphere is in the center square as shown in FIGS. 1 and 3.

The opposing player assigned to the Omega grid is likewise provided with five spheres all having a color different from those used by the first player and he places his five spheres in the five similar playing squares of Omega grid 13.

The rules of play of the Alpha-Omega Encounter game are quite simple. The person to play first is chosen by random selection such as by the flip of a coin or the roll of a die. During his turn, each player can move one of his spheres to any adjoining vacant square. However, if the move is vertical (up or down to a different grid) it must be to the square directly above or below the square occupied by the sphere—diagonal vertical moves are not permitted.

Rather than moving to an adjoining space a player may capture any opposing player's sphere lying vertically or horizontally adjacent to the sphere to be played. Capture is effected by jumping over the opposing player's sphere into a vacant square on the opposite side of the opposing player's sphere and then moving to an adjoining vacant square to complete the capture or jumping move.

The object of the game is either to land one of the player's spheres onto the central square or base of the opposing player or to capture and remove from the gameboard all of the opposing player's spheres, whichever occurs first.

The foregoing rules are quite quickly grasped both by children and adults, but winning the game is largely a matter of skill rather than luck. Hence I believe my game will attract the interest of a great many persons, especially since the game can usually be played to a final conclusion in from 10 to 30 minutes, thus avoiding the long drawn out period of play in games such as chess and the Japanese game of go. Moreover, the fact that the game requires very little in the way of expensive paraphernalia enhances its popularity.

Figure 2:
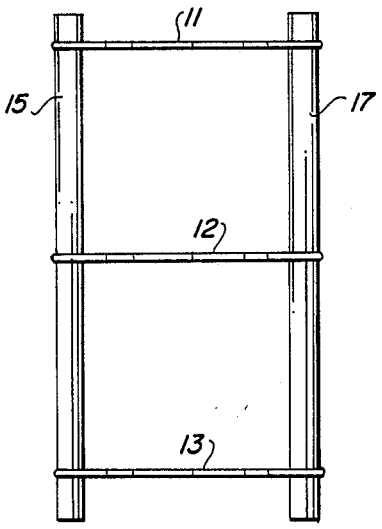
FIG. 2 is a side elevational view of the gameboard shown in FIG. 1.

It would seem apparent to those skilled in the art that the game can be played with playing pieces in the form of pegs, disks or magnetized pieces in a wide variety of shapes. Likewise, the gameboard itself may take various shapes other than that shown in FIGS. 1 and 2 and still provide the same interest and playing technique as described.

Figure 5:
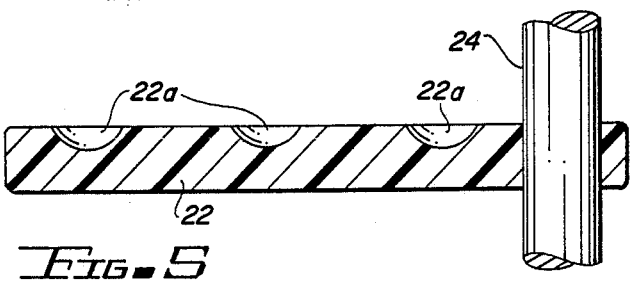
FIG. 5 is a cross-sectional view of a portion of the gameboard shown in FIG. 4 taken along lines 5—5 showing three of the indentations serving as receptacles for the playing pieces.
Figure 4:
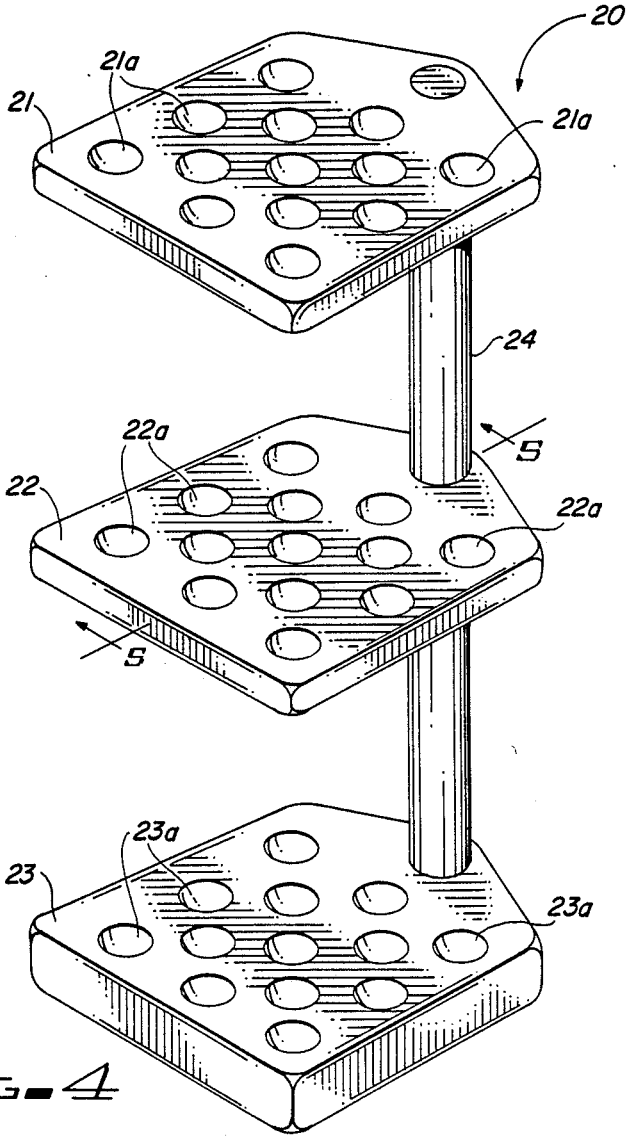
FIG. 4 is a perspective view of a second form of my novel gameboard.

FIGS. 4 and 5 illustrate a second preferred embodiment of my unique gameboard. Gameboard 20 as shown in FIG. 4 is made of a cast plastic material and includes an Alpha grid 21, a neutral grid 22 and an Omega grid and base 23. Grids 21, 22 and 23 are held in parallel spaced apart relationship to each other by a tubular post 24. The playing spaces of each of grids 21, 22 and 23 consist of thirteen spaced apart partial hemispherical receptacles 21*a*, 22*a* and 23*a* respectively which are arranged with respect to each other in a pattern similar to that shown in FIG. 3 except, of course, the spaces are indentations which are circular in plan view rather than squares as shown in FIG. 3. Indentations or receptacles 21*a*, 22*a* and 23*a* are designed to hold or receive playing spheres similar to spheres 18 and 19 shown in FIG. 1.

FIG. 5 is a partially broken away cross-sectional side view taken along line 5—5 of FIG. 4 showing three of the hemispherical indentations or receptacles 22*a* in the upper playing surface of neutral grid 22 with vertical cylindrical post 24 supporting grid 22 in a horizontal position.

While two preferred embodiments of my unique gameboard have been illustrated and described, it should be apparent to those skilled in the art that numerous modifications may be made in the structure of the gameboard and the playing pieces which are the subject of my invention without departing from the spirit of the invention. It is therefore my intention that the scope and spirit of my invention be limited only by the appended claim.

I claim:

1. A method of playing a three-dimensional game comprising the step of providing a total of only ten pieces, five of one color and the other five pieces of a different color, providing a (gameboard having similar top, bottom and middle boards lying in three separate spaced-apart parallel planes, each board similarly containing a total of only 13 spaces, nine of which are arranged into three equally spaced lines of three spaces each to form a central matrix in the shape of a square having a central space with each one of the four remaining spaces being located outside the central matrix square and adjacent to the center of one of the four sides of the central matrix square, and providing support means affixed to each of the three boards for maintaining the three boards in fixed spaced-apart relation to each other, positioning five pieces of one color on the top board and five pieces of the different color on the bottom board, alternately moving each player's pieces of adjoining horizontal and vertical vacant spaces and jumping opposing pieces.

2. A process according to claim 1 wherein the five pieces on the top board and the five pieces on the bottom board are positioned in the four outside spaces and the central space of said top and bottom boards.

3. A process according to claim 2 wherein the pieces are moved until one player's piece lands on the opposing top or bottom board's central space or until all of the opposing pieces have been removed from the board.

4. Apparatus for playing a three-dimensional game consisting essentially of ten identical playing pieces, five of said pieces being of one color and the other five being of a different color, and a gameboard of three similar boards lying in three spaced-apart parallel planes, each board similarly containing a total of only 13 spaces, nine of which are arranged into three equally spaced lines of three spaces each to form a central matrix in the shape of a square with each one of the four remaining spaces being located outside the central matrix square and adjacent to the center of one of the four sides of the central matrix square, and support means affixed to each of the three boards for maintaining the three boards in fixed spaced-apart relation to each other.

5. Apparatus according to claim 4 in which the ten playing pieces are in the form of spheres.

* * * * *